US008870729B2

(12) United States Patent
Lindbäck et al.

(10) Patent No.: US 8,870,729 B2
(45) Date of Patent: Oct. 28, 2014

(54) STRAW APPLICATOR

(75) Inventors: Jonas Lindbäck, Lomma (SE); Gert Hansson, Höör (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 567 days.

(21) Appl. No.: 12/864,463

(22) PCT Filed: Jan. 29, 2009

(86) PCT No.: PCT/SE2009/000035

§ 371 (c)(1),
(2), (4) Date: Aug. 10, 2010

(87) PCT Pub. No.: WO2009/099374

PCT Pub. Date: Aug. 13, 2009

(65) Prior Publication Data

US 2010/0300040 A1 Dec. 2, 2010

(30) Foreign Application Priority Data

Feb. 6, 2008 (SE) ..... 0800271

(51) Int. Cl.
*B65B 61/20* (2006.01)

(52) U.S. Cl.
CPC ..... *B65B 61/205* (2013.01)
USPC ..... 493/84; 53/133.1

(58) Field of Classification Search
CPC ..... B65B 61/205; B29L 2023/008
USPC ..... 53/410, 133.1, 133.2, 128.1; 156/358; 493/84, 87
See application file for complete search history.

(56) References Cited

U.S. PATENT DOCUMENTS 4,293,369 A 10/1981 Dilot et al.
4,384,915 A * 5/1983 Utsumi ..... 156/499
4,584,046 A 4/1986 Geyssel
(Continued)

FOREIGN PATENT DOCUMENTS

EP 1 042 172 B1 4/2004
JP 2-152638 A 6/1990
(Continued)

OTHER PUBLICATIONS

International Search Report (PCT/ISA/210) issued on May 12, 2009 by Swedish Patent Office as the Searching Authority for International Application No. PCT/SE2009/000035.

*Primary Examiner* — Stephen F Gerrity
(74) *Attorney, Agent, or Firm* — Buchanan Ingersoll & Rooney PC

(57) ABSTRACT

An apparatus for applying drinking straws on prefabricated packaging containers includes a drive device for continuous belts of drinking straws wrapped in protective sleeves or envelopes, a conveyor for moving packaging containers past the drinking straw applicator, a separator for separating drinking straws from the belt, as well as an applicator for applying the drinking straw on a side wall of the packaging container. The drinking straw applicator include at least one eccentric which is eccentrically disposed on a shaft mounted adjacent the drive device. During rotation of the shaft, the eccentric is moved from an inner position to an outer position, a drinking straw is picked up at the inner position and is applied on a packaging container at the outer position.

12 Claims, 2 Drawing Sheets

(56) References Cited

U.S. PATENT DOCUMENTS

Figure 1:
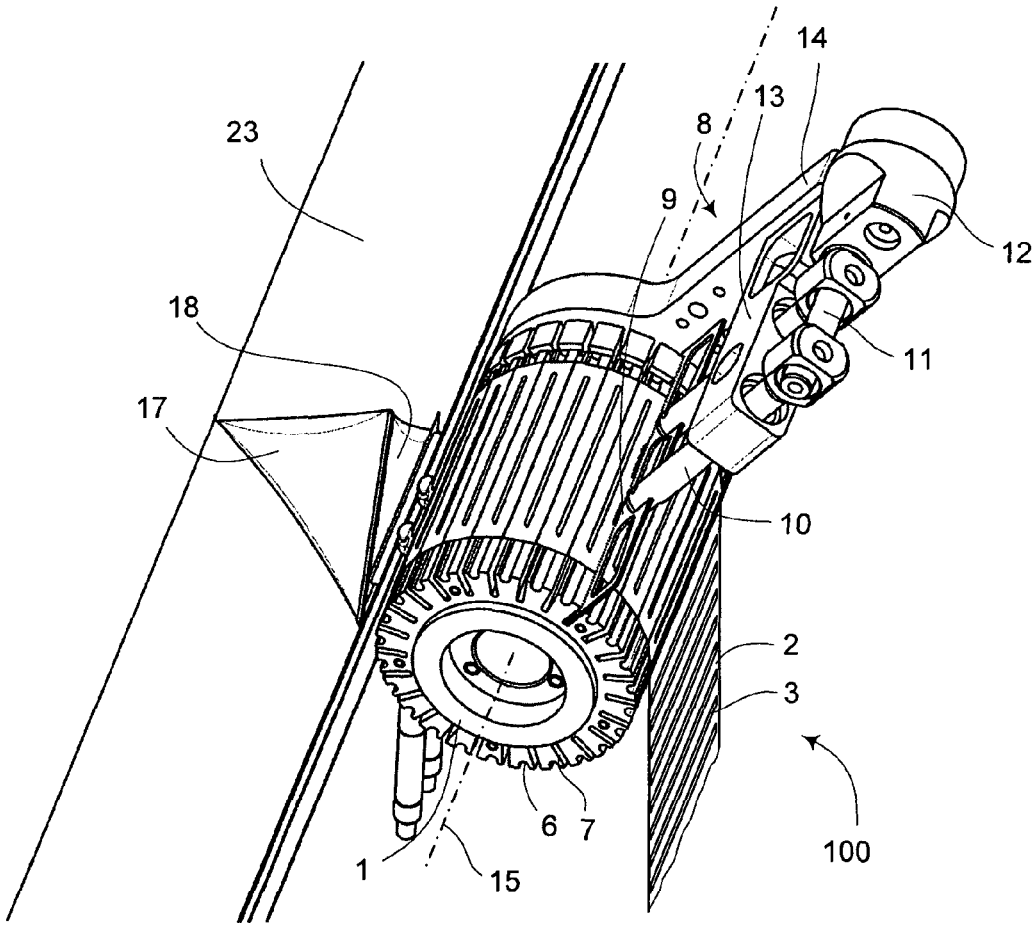

| | | | | |
|---|---|---|---|---|
| 4,584,819 | A | 4/1986 | Hakansson | |
| 4,584,819 | A | 4/1986 | Hakansson | |
| 4,969,308 | A * | 11/1990 | Hakansson | 53/410 |
| 5,037,366 | A | 8/1991 | Yokoyama | |
| 5,979,142 | A | 11/1999 | Kraft et al. | |
| 6,282,865 | B1 | 9/2001 | Bergstrom et al. | |
| 6,526,725 | B1 | 3/2003 | Williams | |

FOREIGN PATENT DOCUMENTS

| | | | |
|---|---|---|---|
| JP | 6-191523 | A | 7/1994 |
| JP | 2000-302110 | A | 10/2000 |
| SE | 424 847 | | 8/1982 |

* cited by examiner

STRAW APPLICATOR

TECHNICAL FIELD

The present invention relates to an apparatus for applying drinking straws to prefabricated packaging containers, comprising a rotary drive means for continuous belts of drinking straws wrapped in protective sleeves, guides for drinking straw belts and drinking straws, a conveyor for the packaging containers, means for separating drinking straws from the belt, as well as means for applying the drinking straw to the side wall of the packaging container.

BACKGROUND ART

Many single-use disposal packages for beverages are manufactured in so-called portion volumes, intended to be consumed straight from the package. The majority of these packages are provided with a drinking straw in a protective sleeve or envelope which is secured on the one side wall of the package. The packages, which may have parallelepipedic or tetrahedral configuration, are manufactured from a laminate with a core of paper or paperboard, with different layers of thermoplastics and possibly aluminium foil (Alifoil). On the one wall of the package, most often the upper or top wall, a hole has been punched out in the core layer and this hole is covered by the remaining layers of the laminate, which makes it possible to penetrate the hole with the drinking straw which accompanies the packaging container, and hereby consume the beverage contained in the package.

There have long existed machines in the art which apply drinking straws in their protective sleeves to packages which are conveyed through the machine. One such a machine is, for example, described in Swedish Patent Specification SE-424 847. These machines operate in that a belt of continuous drinking straw sleeves containing drinking straws is guided in towards and around a drive means. Adjacent the drive means there are devices for cutting the drinking straw belt into individual drinking straws enclosed in a protective sleeve or envelope, and means for applying this drinking straw on the side wall of the packaging container, the packaging container being advanced on a conveyor through the machine. The packaging container is, prior to the occasion of application, provided with so-called hot melt. Hot melt, which consists of molten plastic, adheres to the drinking straw sleeve and holds it in position when it sets. In order to be able to separate each drinking straw and apply the drinking straw on the package, the drive means must operate intermittently or at low speed, and the conveyor must advance the packages either intermittently or at low speed on each application occasion.

Another apparatus for applying drinking straws is disclosed in EP1042172, in which arms which are mounted on eccentric shafts move in towards the drive means and pick up a drinking straw. Thereafter, the arms take the drinking straw back and apply it on the packaging container. The eccentric shafts are disposed such that the arms, on the application of the drinking straw, accompany the packaging container. As a result, the conveyor with packaging containers need not be stopped on application of drinking straws. However, the design and construction involving arms placed on eccentric shafts is relatively heavy and cannot be employed at high speeds. With today's state-of-the-art and more rapid filling machines in which the packaging containers are manufactured, the demands have increased to evolve more rapid machines for applying drinking straws.

BRIEF SUMMARY OF THE INVENTION

One object of the present invention is to realise a machine for applying drinking straws on packaging containers which may operate more rapidly, since both drive means and conveyor operate continuously and the design and construction is simplified.

This and other objects have at least partly been attained by means of the present invention.

An apparatus for applying drinking straws on prefabricated packaging containers comprises drive means for continuous belts of drinking straws wrapped in protective sleeves or envelopes, a conveyor for advancing packaging containers past the drinking straw applicator, means for separating drinking straws from the belt, as well as means for applying the drinking straw on the side wall of the packaging container. The means for applying the drinking straw comprises at least one eccentric which is eccentrically disposed on a shaft which is mounted adjacent the drive means, the eccentric, on rotation of the shaft, being moved from an inner position to an outer position, the drinking straw being picked up at the inner position and applied on a packaging container at the outer position. As a result, there will be realised an applicator which, by rotation of a shaft provided with an eccentric, may be run at high speed.

Preferred embodiments of the present invention have further been given the characterising features as set forth in the appended subclaims.

BRIEF DESCRIPTION OF THE ACCOMPANYING DRAWINGS

Figure 2A:
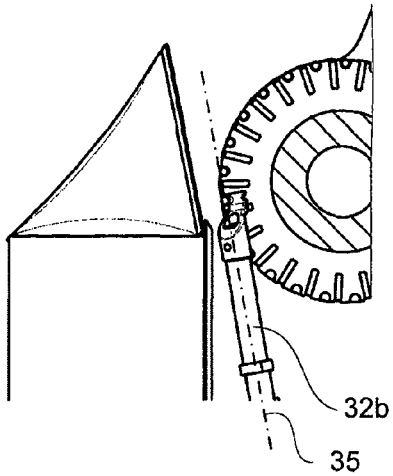
Figure 2B:
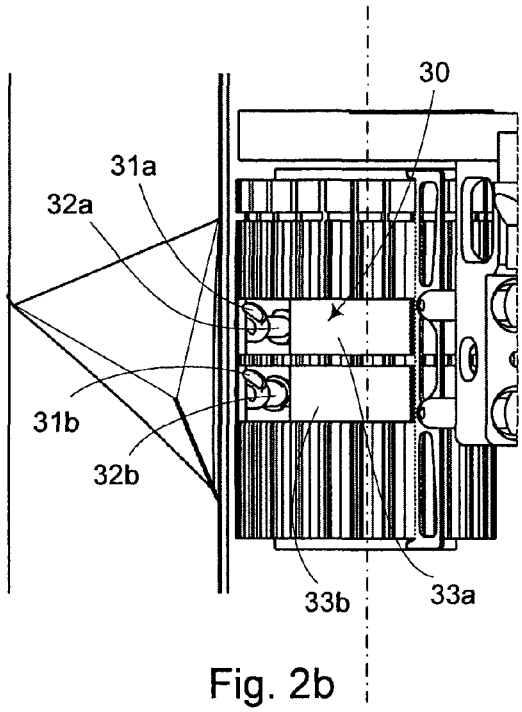
Figure 3A:
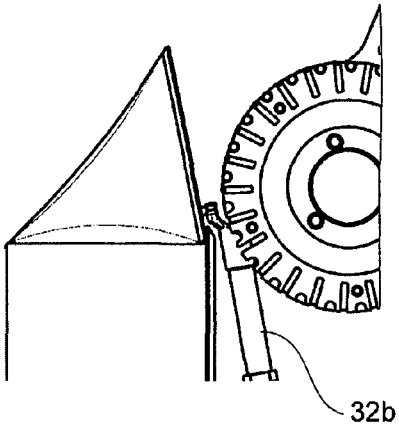
Figure 3B:
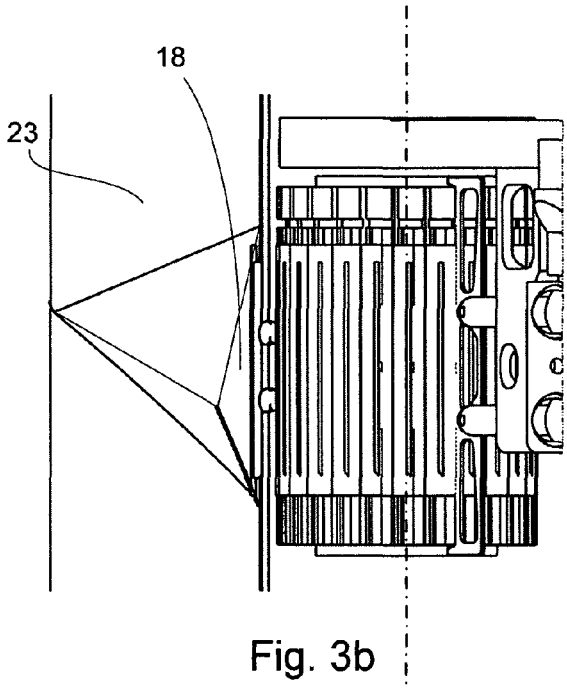

One preferred embodiment of the present invention will now be described in greater detail hereinbelow, with reference to the accompanying Drawings. In the accompanying Drawings:

FIG. 1 is an isometric detailed illustration of the central parts of the apparatus according to the present invention;

FIGS. 2*a* and 2*b* are a side elevation and a top plan view where eccentrics in an apparatus for applying drinking straws are located in an inner position; and FIGS. 3*a* and 3*b* are a side elevation and a top plan view where the eccentrics of the apparatus are in an outer application position.

The accompanying Drawings show only those details essential to an understanding of the present invention, and the remaining parts of the applicator machine, which are well-known to a person skilled in the art, have been omitted.

DETAILED DESCRIPTION OF PREFERRED EMBODIMENTS

Referring to the Drawings, FIG. 1 shows central parts of an apparatus 100 for applying drinking straws with the included components which are vital for the function of the apparatus. The apparatus includes a drive means 1, a so-called feeder wheel. To the drive means 1 there is advanced a continuous belt 2 of drinking straws 3 in protective sleeves or envelopes. The drinking straws 3 are advanced by the intermediary of guides, which are not shown in the Drawings, as well as guides (not shown), surrounding the drive means 1 and fixedly holding drinking straw belt 2 and drinking straws 3 against the drive means 1. On, its circumferential surface, the drive means 1 displays a number of grooves 6 which are each intended for a drinking straw 3. The number of grooves 6 on the drive means 1 depends upon the thickness and form of the drinking straw 3. Thus, a drive means 1 intended for straight or telescopic drinking straws 3 may have seventeen grooves 6 on its surface, while a drive means 1 for U-shaped drinking straws 3 may have twelve grooves 6. The number of grooves may be modified if a drive means with a larger or smaller diameter is employed. The drive means 1 is driven by a first servomotor (not shown).

Between each groove 6 on the circumferential surface of the drive means 1 there is disposed a slot 7. The slot 7 is intended to receive a device 8 for separating drinking straws 3 from the drinking straw belt 2. The device 8 for separating drinking straws 3 is in the form of a knife 9 fixedly secured in a holder 10. The knife 9 with its holder 10 are secured on an eccentric shaft 11. The device 8 moreover includes a guide 13 which is fixed to a support arm 14. The support arm 14 is journalled about the centreline 15 of the drive means 1, and ensures that the guide 13 constantly holds the knife 9 directed towards the centre of the drive means 1. The eccentric shaft 11 is disposed on a drive pulley 12 which is driven by a motor (not shown) which may be the same motor which drives the drive means 1. In such an event, a gear is disposed between the drive means 1 and the drive pulley 12 in that, for example, a driving belt drives the drive means 1 and the drive pulley 12 by means of pulleys of different sizes.

The apparatus further includes a device 30 for applying a drinking straw 3 on the side wall 18 of a packaging container. The device 30 for applying drinking straws includes one, two or more eccentrics 31*a*, 31*b* which, in the illustrated embodiment, are each mounted on its substantially vertical shaft 32*a*, 32*b*, as shown in FIGS. 2*a* and 2*b*. At least one shaft 32*a*, 32*b* may be directly driven by a second servomotor (not shown), and in the case involving more than one eccentric, the shaft for this eccentric may be driven indirectly by the servomotor, with the aid of a prior art power transmission such as a gear wheel, drive belt or the like (not shown). The eccentrics 31*a*, 31*b* are positioned slightly offset in relation to the axis of rotation 35 of the shafts 32*a*, 32*b*, see FIG. 2*a*.

Along its diameter, the drive means 1 is provided with at least one peripheral groove 33*a*, 33*b*, see FIG. 2*b*, in order to accommodate therein the at least one eccentric 31*a*, 31*b*. The eccentric 32*a*, 32*b* is mounted so that, irrespective of rotation, it is freely-going from the drive means 1, and so that the eccentric, in an inner position, is radially inside a position of a drinking straw 3 which is to be applied, and so that the eccentric 32*a*, 32*b* in an outer position may move a drinking straw 3 into contact with the side wall of a packaging container, see FIGS. 2*a* and 2*b*. The peripheral groove 33*a*, 33*b* is disposed so that the drive means 1 will there consist of a cylindrical portion of smaller diameter.

The first servomotor (not shown) drives the drive means 1, and in its turn the drive means 1 feeds in the drinking straws 3 which are mounted on drinking straw belts 2. This first servomotor drives the drive means with the aid of a drive belt, but other power transmission systems are conceivable, such as friction driving or gear wheel driving. Normally, a gear is disposed in connection with the power transmission, so that the drive means may operate at a controlled, slow speed despite driving by a motor at high speed.

Adjacent the drive means, a conveyor 23 is disposed, and conveys finished packages from a packing and filling machine towards a carton packer or the like, where applicable. The packages are given a certain orientation and are controlled relatively accurately so as to pass the drive means in a well-marshalled manner and at a certain distance therefrom.

The drive means 1, which is disposed to rotate continuously, is the cardinal unit in the apparatus. It is the drive means 1 which conveys the drinking straws 3 around from the time when the belt 2 of continuous drinking straws 3 wrapped in protective sleeves or envelopes arrives at the apparatus by the intermediary of a number of guides (not shown in the Drawings), around the circumferential surface of the drive means 1, past the device 8 for separation to the device 30 for application. The device 8 for separation of drinking straws 3 moves with a gearing from the servomotor which drives the drive means 1, which depends upon the number of grooves 6 on the circumferential surface of the drive means 1. Thus, the gear ratio for straight drinking straws 3 may be 17:1, and the gear ratio for U-shaped drinking straws 3 may be 12:1, so that one drinking straw has been separated during the rotation necessary for the drive means 1 to apply one drinking straw on one packaging container 17. Other ratios are naturally conceivable.

The device 8 for separating drinking straws 3 from the belt 2 executes two relative movements during each separation sequence. On the one hand, the knife 9 is to reciprocate radially in relation to the drive means 1 and into a slot 7. On the other hand, the separation device 8 must accompany the substantially continuously rotating drive means 1 during the time the separation sequence is in progress. Both of these movements are realised by means of the drive pulley 12 and the eccentric shaft 11 eccentrically disposed thereon. Once the separation sequence is completed and the knife 9 has severed one drinking straw 3 in its protective sleeve or envelope from the continuous belt 2, the separation device 8 returns to its original starting position and there stands by awaiting a new separation sequence.

Moving tangentially in relation to the drive means 1 is the conveyor 23 which conveys through the apparatus the packaging containers 17 which are to be provided with drinking straws 3. The conveyor or conveyor path 23 moves at a speed which is synchronized with the speed of the remaining components in the apparatus. Before the packaging containers 17 arrive at the drive means 1, they have been provided on their side surface 18 with a number, preferably two, of glue spots which consist of so-called hot melt adhesive. The hot melt spots are to adhere to and, once they have set, retain the drinking straw 3 in its protective sleeve or envelope against the side wall 18 of the packaging container 17.

The device 30 for applying drinking straws 3 on the side walls of the packaging containers 17 rotates about the at least one eccentric 31*a*, 31*b* so that it moves from its inner position to its outer position. During this displacement, the eccentric 31*a*, 31*b* will entrain with it a drinking straw 3 which has been placed radially outside the inner position of the eccentric 31*a*, 31*b*, as a result of the rotation of the drive means 1, to the outer position. When the eccentric is in its outer position, the drinking straw is pressed in place on that packaging container which is positioned on the conveyor path and which, on its side wall, is provided with one or more spots of hot melt adhesive. Thereafter, the finished package is conveyed off by the conveyor 23, a new package is advanced and provided with hot melt, a new drinking straw 3 is advanced by the drive means 1 and the eccentric is rotated and once again applies a drinking straw 3 on the packaging container. The movement of the drinking straw 3 is substantially straight out from the drive means 1, at right angles to its axis, when it is moved by the eccentric 31*a*, 31*b*. At the end of the movement of the eccentric 31*a*, 31*b*, the drinking straw will for a brief time accompany the eccentric and then is moved in the direction of movement of the package 17. This facilitates application of drinking straws 3.

The above-described procedure requires synchronization of a number of movements. The whole process is started in that a photocell or similar sensor senses the presence of a packaging container 17. In a first step, hot melt adhesive is then applied to the side wall 18 of the container with the aid of a hot melt applicator (not shown). Thereafter, the container is advanced by the conveyor 23 to the correct position ahead of the drive means 1. When this position is confirmed, by another sensor (not shown), the servomotor for the shaft 32*a*, 32*b* is activated for applying the drinking straw 3. The eccentric 31*a*, 31*b* is driven from its inner position to its outer position and then entrains a drinking straw. Thereafter, the drive means 1 is driven for advancement of a new drinking straw. In association with this rotation, a separation device will be activated so as to separate a drinking straw 3 from the belt of drinking straws. This procedure must be completed before a drinking straw can be applied on a container, but may be carried out slightly earlier so that a plurality of drinking straws lies separated in the grooves 6 in the drive means 1.

The synchronization of these different driving and activation phases is managed by an automation system (not shown) which moreover receives data from different sensors with regard to the current position of the next packaging container. This is vital in connection with the application of hot melt adhesive on the side wall of the packaging container, and in connection with the application of the drinking straw. The two servomotors, for the drive means 1 and the device 30 for applying drinking straws, are thus completely and totally synchronized in terms of software. The conveyor 23 may be synchronized with the drive means 1 and the device 30 for applying drinking straws, but may also be completely independent. Instead, the drinking straw applicator then responds to sensor signals which indicate where the relevant package is located.

It is advantageous if the packing and filling machine is provided with a positioning device (not shown) in order, as far as is possible, accurately to orientate the packages in the same manner each time. Then, the drinking straw may be applied at the same position on all packages, i.e. on a panel or side wall 18 intended for this purpose.

As will have been apparent from the foregoing description, the present invention realises an apparatus for applying drinking straws 3 on packaging containers 17 at high speed, since both the drive means 1 and the conveyor 23 move substantially continuously, and where the design and construction are simple and the moving parts are of slight mass. The drive means and other parts included may also be driven intermittently, and at varying speed, in response to signals from different sensors. In the event of a high flow of packages past the drinking straw applicator, it will operate more or less continuously, while in the event of a low flow, it will operate when necessary and at a lower speed of the drive means 1. The device 30 for applying drinking straws 3 moves, in one embodiment, at a speed which is adapted to the speed of the conveyor 23.

The device 30 for applying drinking straws on the packaging container 17 is totally free-running from the drive means 1, and its eccentric shafts 32*a*, 32*b* execute substantially a rotation movement. This is converted to a movement in the radial direction of the drinking straw as a result of the positioning of the eccentric on the shaft. This eccentric is of low mass, which makes it possible to drive it at high speed without inertia forces becoming excessively great.

What is claimed is:

1. An apparatus for applying drinking straws on prefabricated packaging containers, comprising a drive means for continuous belts of drinking straws wrapped in protective sleeves or envelopes, a conveyor for moving packaging containers past the drinking straw applicator, means for separating drinking straws from the belt and means for applying the drinking straw on the side wall of the packaging container, wherein said means for applying the drinking straw comprises at least one eccentric which is eccentrically disposed on a shaft mounted adjacent the drive means, said shaft being accommodated in at least one peripheral groove of the drive means, said at least one eccentric, during rotation of the shaft, being moved from an inner position to an outer position, a drinking straw being picked up at the inner position and applied on a packaging container at the outer position.

2. The apparatus as claimed in claim 1, wherein said means for separating drinking straws at least at times moves together with said drive means so that the separation may take place without the running of the drive means being discontinued or decelerated.

3. The apparatus as claimed in claim 1, wherein said means for separating drinking straws consists of a knife and a holder therefore, which are secured on an eccentric shaft which is eccentrically mounted on a drive pulley, and a guide journalled about the centre of rotation of said drive means, in which the holder and thus the knife are constantly held directed towards the centre of the drive means.

4. The apparatus as claimed in claim 1, wherein there are a plurality of eccentrics having the same eccentricity.

5. The apparatus as claimed in claim 1, wherein said drive means and said means for applying drinking straws are each driven by its servomotor.

6. The apparatus as claimed in claim 5, wherein the servomotors for driving said drive means and said means for applying drinking straws are synchronized with the aid of an automation system.

7. The apparatus as claimed in claim 1, wherein said drive means displays on its circumferential surface a number of grooves each one intended to receive a drinking straw.

8. The apparatus as claimed in claim 7, wherein said drive means is disposed to move the distance of one groove for each packaging container which passes the drive means.

9. The apparatus as claimed in claim 1, wherein a guide for drinking straw belts is disposed adjacent the drive means so that the drinking straw belt encompasses more than a quarter of the circumference of the drive means.

10. The apparatus as claimed in claim 1, wherein a guide for separated drinking straws is disposed between the means for separating and the at least one eccentric so that the drinking straws remain in grooves intended therefore until such time as the drinking straws are applied on the side wall of a packaging container.

11. The apparatus as claimed in claim 1, wherein the at least one eccentric is accommodated in the at least one peripheral groove and is free-running from said drive means.

12. The apparatus as claimed in claim 1, wherein the at least one eccentric, at the end of its contact with the drinking straw during the application on a packaging container, at least partly drives the drinking straw in a direction which corresponds with a direction of transport of the packaging container on the conveyor.

* * * * *